US008948580B2

(12) United States Patent
Rodriguez et al.

(10) Patent No.: US 8,948,580 B2
(45) Date of Patent: Feb. 3, 2015

(54) FOAM DAM FOR APPLIANCE

(75) Inventors: Eliel Fresco Rodriguez, Dayton, OH (US); Samuel Vincent Duplessis, Louisville, KY (US)

(73) Assignee: General Electric Company, Schenectady, NY (US)

( * ) Notice: Subject to any disclaimer, the term of this patent is extended or adjusted under 35 U.S.C. 154(b) by 212 days.

(21) Appl. No.: 13/571,789

(22) Filed: Aug. 10, 2012

(65) Prior Publication Data

US 2013/0044998 A1 Feb. 21, 2013

Related U.S. Application Data

(60) Provisional application No. 61/524,418, filed on Aug. 17, 2011.

(51) Int. Cl.

| | |
|---|---|
| ***A47J 27/00*** | (2006.01) |
| ***F24H 1/20*** | (2006.01) |
| ***F28D 15/00*** | (2006.01) |
| ***B21D 53/02*** | (2006.01) |
| ***F24H 9/02*** | (2006.01) |
| ***F24H 9/12*** | (2006.01) |
| *F24H 4/04* | (2006.01) |

(52) U.S. Cl.

CPC ..... *F28D 15/00* (2013.01); *B21D 53/02* (2013.01); *F24H 9/02* (2013.01); *F24H 9/124* (2013.01); *F24H 4/04* (2013.01)

USPC ..... 392/441; 392/447; 392/501; 392/455; 122/19.2

(58) Field of Classification Search

None

See application file for complete search history.

(56) References Cited

U.S. PATENT DOCUMENTS

| | | | | | |
|---|---|---|---|---|---|
| 3,116,402 | A | * | 12/1963 | Drugmand | 392/455 |
| 4,765,507 | A | * | 8/1988 | Yavorsky et al. | 220/590 |
| 5,292,464 | A | | 3/1994 | Hanning et al. | |
| 5,299,280 | A | | 3/1994 | Ruark | |
| 5,371,831 | A | * | 12/1994 | Gauer et al. | 392/501 |
| 5,419,449 | A | | 5/1995 | Hanning et al. | |
| 5,460,290 | A | | 10/1995 | Hanning et al. | |
| 6,349,169 | B1 | * | 2/2002 | Jackson et al. | 392/447 |
| 6,898,375 | B2 | * | 5/2005 | Henderson et al. | 392/478 |
| 7,516,721 | B2 | * | 4/2009 | Syler | 122/19.2 |
| 7,592,571 | B2 | * | 9/2009 | Theodos | 219/437 |

FOREIGN PATENT DOCUMENTS

JP 2011069503 A2 4/2011

* cited by examiner

*Primary Examiner* — Thor Campbell

(74) *Attorney, Agent, or Firm* — Global Patent Operation; Douglas D. Zhang

(57) ABSTRACT

An apparatus includes an inner rim, a base wall, a side wall and an outer rim. The inner rim has a first opening formed therein. The base wall extends outward from an inner edge of the inner rim and is integral with the inner rim. The side wall extends outward from an outer edge of the inner rim and is integral with the inner rim. The outer rim has a second opening formed therein and an inner edge integral with the side wall. The inner rim, base wall, side wall and outer rim are formed to prevent liquid seepage to one or more surrounding components of an appliance in which the apparatus is installed.

19 Claims, 2 Drawing Sheets

FOAM DAM FOR APPLIANCE

CROSS REFERENCE TO RELATED APPLICATION

The present application claims priority to the U.S. Provisional Application identified as Ser. No. 61/524,418, filed on Aug. 17, 2011, entitled "Condenser, Shroud, Foam Dam and Drip Plate for Water Heater," the disclosure of which is incorporated by reference herein.

BACKGROUND OF THE INVENTION

The subject matter disclosed herein relates to appliances such as water heaters, and more particularly to techniques for preventing water seepage in water heaters.

Water heaters including heat pump water heaters (HPWHs) utilize a number of heating elements. Water heaters typically comprise a tank which stores water, a number of heating elements, a layer of foam surrounding the tank, and a wrapper surrounding the layer of foam. In addition, water heaters may have an external condenser placed between the tank and the layer of foam.

During the life of a water heater, the heating element will typically need to be serviced several times. To facilitate servicing of heating elements, the heating elements are placed such that at least a portion of the heating element protrudes from the tank, the foam and the wrapper of a water heater. It is important to keep the foam which surrounds the water heater dry to maintain heat efficiency and prevent corrosion of various parts of the water heater.

BRIEF DESCRIPTION OF THE INVENTION

As described herein, the exemplary embodiments of the present invention overcome one or more disadvantages known in the art.

In one embodiment, an apparatus comprises an inner rim, a base wall, a side wall and an outer rim. The inner rim has a first opening formed therein. The base wall extends outward from an inner edge of the inner rim and is integral with the inner rim. The side wall extends outward from an outer edge of the inner rim and is integral with the inner rim. The outer rim has a second opening formed therein and an inner edge integral with the side wall. The inner rim, base wall, side wall and outer rim are formed to prevent liquid seepage to one or more surrounding components of an appliance in which the apparatus is installed.

In another embodiment, a water heater comprises a tank, a layer of foam surrounding the tank, a wrapper surrounding the layer of foam, at least one heating element, and at least one foam dam. A portion of the heating element protrudes from an opening in the tank, the layer of foam and the wrapper. The foam dam surrounds the at least one heating element and at least a portion of one of the opening in the tank, the layer of foam and the wrapper. The foam dam comprises an inner rim, a base wall, a side wall and an outer rim. The inner rim has an opening formed therein and configured to fit around a portion of the heating element. The base wall extends outward from an inner edge of the inner rim and is integral with the inner rim. The side wall extends outward from an outer edge of the inner rim and is integral with the inner rim. The outer rim has a second opening formed therein and an inner edge which is integral with the side wall.

In yet another embodiment, a method comprises aligning a first opening of a foam dam with a portion of a heating element protruding from a water heater, aligning a second opening of a foam dam with an opening in the water heater, placing a gasket under a lip of an outer edge of the foam dam between the foam dam and a wrapper of the water heater and securing the foam dam to the opening in the water heater. The foam dam comprises an inner rim, a base wall, a side wall, an outer rim and a lip. The inner rim has a first opening formed therein and configured to fit around a portion of the heating element. The base wall extends outward from an inner edge of the inner rim and is integral with the inner rim. The side wall extends outward from the outer edge of the inner rim and is integral with the inner rim. The outer rim has the second opening formed therein and an inner edge which is integral with the side wall. The lip slopes outwards from an outer edge of the outer rim towards the base wall.

Advantageously, embodiments of the invention prevent liquid seepage and foam leakage in an appliance.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

One or more of the embodiments of the invention will be described below in the context of an exemplary HPWH. However, it is to be understood that the embodiments of the invention are not intended to be limited solely to the HPWHs described herein. Rather, embodiments of the invention may be applied to and deployed in other suitable environments in which it would be desirable to improve the performance of appliances and reduce liquid seepage.

Water seepage is a problem for various types of water heaters including HPWHs. Water or other liquids which wet the foam surrounding the water tank can drastically reduce the efficiency of the water heater. Water or other liquids can also cause corrosion of the tank, a condenser surrounding the tank, a bottom cover of the water heater, and various other components of the water heater. In addition, during maintenance of the heating elements in a water heater, there is a risk of wetting the foam insulating the tank, which reduces the efficiency of the water heater. For a water heater which uses an external condenser, there is also a risk of corroding the condenser. In addition, when installing foam around a water heater, openings to water heater parts such as heating elements may be required to allow servicing of these parts. There exists a need to reduce foam from seeping out of the jacket or wrapper of the water heater, which is also referred to as foam leakage. Wire passages running from heating elements to a power source or controller of the water heater can also increase the risk of foam leakage.

Embodiments of the invention utilize a foam dam to advantageously reduce the amount of water or other liquids which leak out through the heating element port into foam surrounding the tank of a water heater and reduce foam leakage through wire passages or other openings. The foam dam may also protect against water seepage into the foam from external sources, as well as from manufacturing or installation defects in heating elements of a water heater. The foam dam seals around a heating element port and on the outside of the jacket to prevent liquid seepage. The foam dam includes a webbed feature to allow the passage of a wire while preventing foam leaks.

Figures 1, 2:
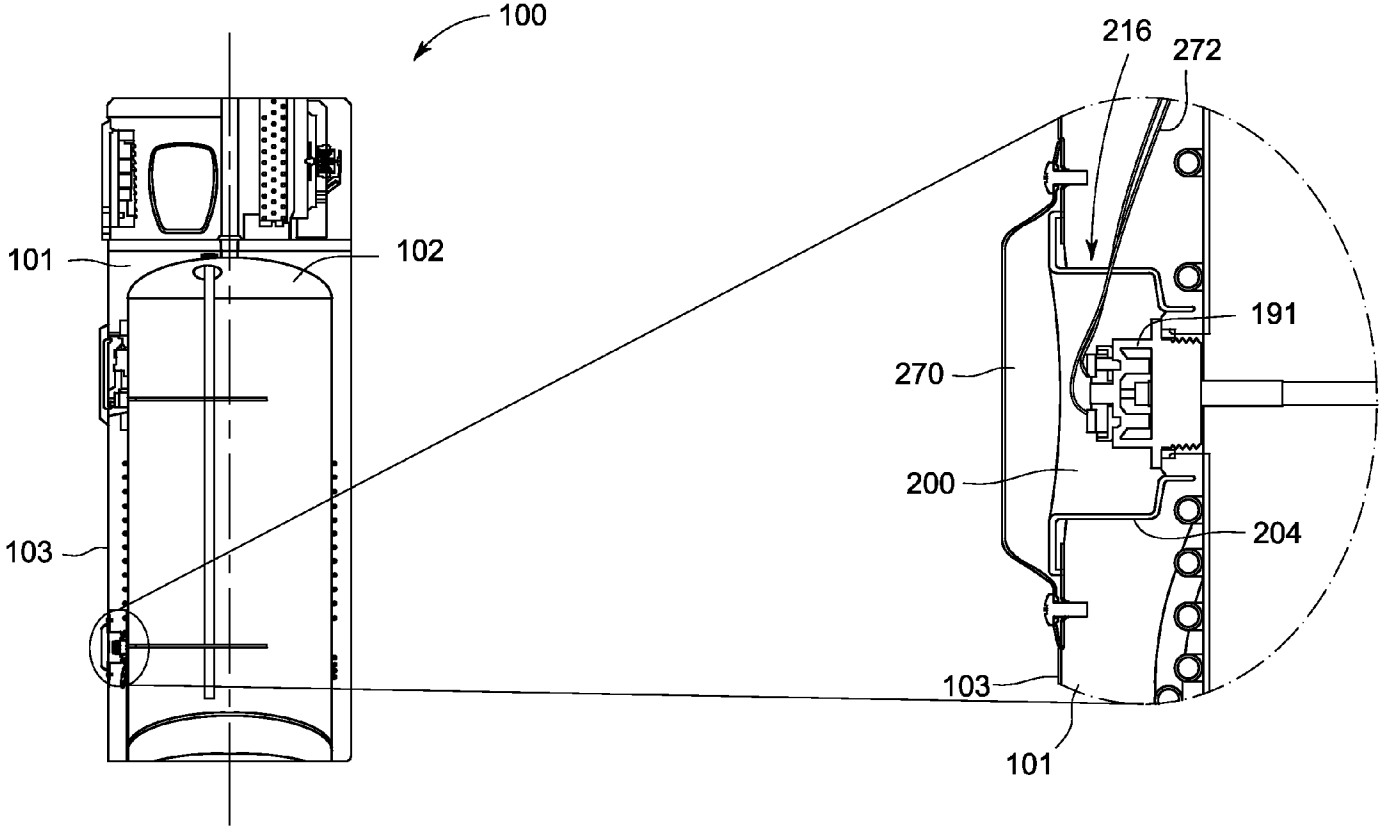
FIG. 1 is a cross-sectional side view of a water heater with a foam dam, according to an embodiment of the invention.
FIG. 2 is an exploded cross-sectional view of the foam dam of FIG. 1.
Figure 3:
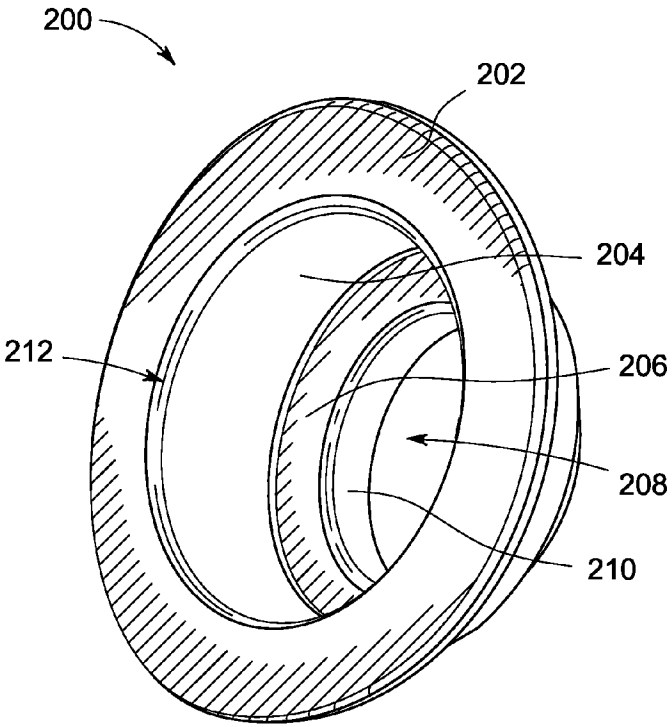
FIG. 3 is a perspective front view of the foam dam of FIGS. 1 and 2.

FIG. 1 is a cross-sectional side view of a water heater 100 including a foam dam 200. FIG. 2 is an exploded cross-sectional view of the foam dam 200 of FIG. 1. FIG. 3 is a perspective front view of the foam dam 200 of FIGS. 1 and 2. FIG. 3 is a perspective back view of the foam dam 200 of FIGS. 1-3. Referring to FIGS. 1-4, the water heater 100 includes a tank 102 encased in foam 101 and encased in a wrapper (jacket) 103. The wrapper 103 may be formed of metal or any other suitable material. A heating element comprising a base 191 which fits within an opening 190 formed in the tank 102, and a heater portion of the heating element which projects into the tank 102. An opening aligned with the opening 190 in tank 102 is formed in the wrapper and the foam to provide access to the heating element.

Figure 4:
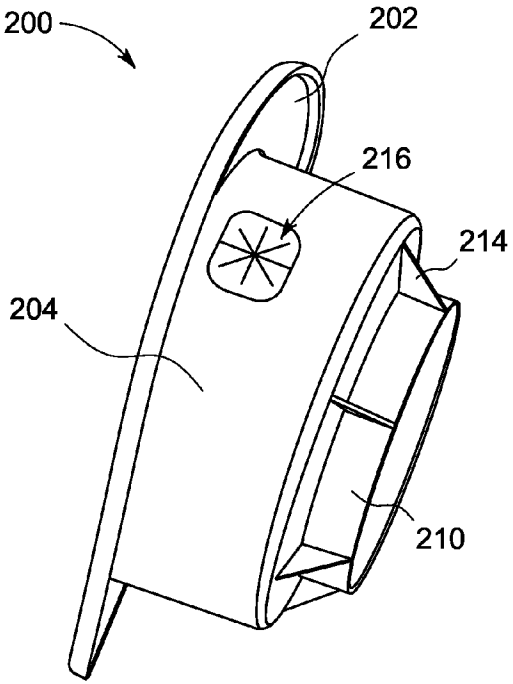
FIG. 4 is a perspective back view of the foam dam of FIGS. 1-3.

As more clearly seen in FIGS. 3 and 4, the foam dam 200 comprises an outer rim 202, an annular sidewall 204, an inner rim 206, an annular base 210, a set of supports 214, and a webbed opening 216. The annular base 210 has a first opening 208 therein. This first opening 208 has a diameter that fits closely around a portion of the heating element 191 that projects from the tank 102 (FIGS. 1 and 12). The set of supports 214 (one or more structural members) are integrally formed with the base 210. The base 210 expands into an inner rim 206. A surface of the inner rim 206 is substantially orthogonal to a surface of the base 210. The inner rim 206 is integrally attached to the annular sidewall 204. The inner rim 206 and the annular sidewall 204 are positioned substantially orthogonal to each other. The annular sidewall 204 is integrally attached to the outer rim 202. The outer rim 202 is positioned substantially orthogonal to the annular sidewall 204 and substantially parallel with the inner rim 206. The inner edge of the outer rim 202 forms a second opening 212.

In one embodiment, the second opening 212 is larger than the first opening 208 to provide easy access to the heating element 191 protruding through the first opening 208. In one embodiment, the sidewall 204 has the webbed opening 216 formed therein. A backside of the outer rim 202 is recessed to receive an annular gasket (not shown). When fully assembled, the gasket is received in the recess and sandwiched between the backside of the outer rim and the seals between the foam dam 200 and the exterior wrapper 103. Supports 214 connect an outer surface of the base 210 with a lower surface of the inner rim 206.

Installed, as shown in FIGS. 1 and 2, the sidewall 204 of the foam dam 200 surrounds the portion of the heating element 191, that projects out of the tank 102, and the rim 202 of the foam dam 200 overlaps and couples with an opening formed in the wrapper 103. A removable cover 270 fastened to the metal wrapper 103 conceals the foam dam 200 and the heating element 191 from view. The webbed opening 216 of the foam dam 200 prevents foam from entering the interior of the foam dam 200 but allows one or more wires 272 to be inserted through the foam dam's sidewall 204.

The foam dam 200 may be made of any suitable material, including a polymer or plastic material. In some embodiments, the foam dam 200 may be a rigid structure so as to secure to the opening in the wrapper 103 via a friction fit. In other embodiments, the foam dam 200 may be a flexible structure so as to flexibly fit within the opening in the wrapper 103. While not explicitly shown in FIGS. 1-4, the foam dam 200 may be secured to the opening in the wrapper 103 by one or more snaps, tabs, slots and/or fastener features. In a preferred embodiment, the foam dam is inserted before foaming the tank, and is held in place by friction between the foam dam part and the port to which it is assembled. After the foam dam is assembled, it is additionally held in place with a fixture or jig such that it cannot be pushed out or moved while the foam is injected into the space, as well as while the foam expands and cures.

It is to be appreciated that while the foam dam design is described herein with respect to a water heater (and, in particular, a HPHW), the foam dam design can be implemented in other appliances where water seepage and/or foam leakage can occur. In addition, the foam dam described herein may be used in conjunction with other water seepage abatement techniques, such as those disclosed in the U.S. patent application U.S. patent application Ser. No. 13/571,850, entitled "Water Seepage Abatement in Water Heaters," which is filed concurrently herewith and incorporated by reference herein. The foam dam described herein may also be used in conjunction with external condensers, such as those disclosed in the U.S. patent application Ser. No. 13/571,726, entitled "Condenser for Water Heater," which is filed concurrently herewith and incorporated by reference herein.

As used herein, an element or function recited in the singular and preceded with the word "a" or "an" should be understood as not excluding plural said elements or functions, unless such exclusion is explicitly recited. Furthermore, references to "one embodiment" of the claimed invention should not be interpreted as excluding the existence of additional embodiments that also incorporate the recited features.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the scope of the following claims.

What is claimed is:

1. An apparatus comprising:

an inner rim having a first opening formed therein;

a base wall extending outward from an inner edge of the inner rim and integral with the inner rim;

a side wall extending outward from an outer edge of the inner rim and integral with the inner rim; and an outer rim having a second opening formed therein and an inner edge integral with the side wall;

the inner rim, the base wall, the side wall and the outer rim formed to prevent liquid seepage to one or more surrounding components of an appliance in which the apparatus is installed, wherein a surface of the inner rim and a surface of the base wall are substantially orthogonal to one another, wherein the surface of the inner rim and a surface of the side wall are substantially orthogonal to one another, wherein a surface of the outer rim and the surface of the side wall are substantially orthogonal to one another, and wherein the surface of the outer rim and the surface of the inner rim are substantially parallel to one another.

2. The apparatus of claim 1, wherein the first opening is configured to fit around a portion of a heating element of a water heater.

3. The apparatus of claim 1, wherein the second opening is larger than the first opening and configured to allow access to a portion of a heating element of a water heater.

4. The apparatus of claim 1, wherein the side wall comprises one or more webbed features.

5. The apparatus of claim 4, wherein at least one of the one or more webbed features is positioned along a path of a wire connecting a heating element of a water heater to one or more other elements of the water heater, the wire passing through said at least one of the one or more webbed features.

6. The apparatus of claim 5, wherein the one or more other elements comprise at least one of a controller of the water heater and a power source of the water heater.

7. The apparatus of claim 1, further comprising a lip sloping outward from an outer edge of the outer rim towards the base wall.

8. The apparatus of claim 1, further comprising a cover attached to the outer rim.

9. The apparatus of claim 8, wherein the cover is configured to hide a heating element from view in a first configuration and expose the heating element in a second configuration.

10. The apparatus of claim 1, wherein the outer rim is positioned around an opening in a wrapper of a water heater, the opening in the wrapper surrounding a heating element of the water heater.

11. The apparatus of claim 1, wherein the inner rim, the base wall, the side wall and the outer rim are made of a polymer material or a plastic material.

12. A water heater comprising:

a tank;

a layer of foam surrounding the tank;

a wrapper surrounding the layer of foam;

at least one heating element, a portion of the heating element protruding from an opening in the tank, the layer of foam and the wrapper; and at least one foam dam surrounding the at least one heating element and at least a portion of one of the opening in the tank, the layer of foam and the wrapper, the foam dam comprising:

an inner rim having a first opening formed therein and configured to fit around a portion of the at least one heating element;

a base wall extending outward from an inner edge of the inner rim and integral with the inner rim;

a side wall extending outward from an outer edge of the inner rim and integral with the inner rim; and an outer rim having a second opening formed therein and an inner edge integral with the side wall, wherein a surface of the inner rim and a surface of the base wall are substantially orthogonal to one another, wherein the surface of the inner rim and a surface of the side wall are substantially orthogonal to one another, wherein a surface of the outer rim and the surface of the side wall are substantially orthogonal to one another, and wherein the surface of the outer rim and the surface of the inner rim are substantially parallel to one another.

13. The water heater of claim 12, wherein the side wall comprises one or more webbed features, at least one of the one or more webbed features being positioned along a path of a wire connecting the heating element to one or more other elements of the water heater, the wire passing through said at least one of the one or more webbed features.

14. The apparatus of claim 12, wherein the foam dam further comprises a lip sloping outwards from an outer edge of the outer rim towards the base wall.

15. The apparatus of claim 14, wherein the lip forms a recess between a backside of the outer rim and the wrapper.

16. The apparatus of claim 1, further comprising a cover attached to the wrapper of the water heater, the cover being configured to hide the foam dam and heating element from view in a first configuration and expose the foam dam and heating element in a second configuration.

17. A method comprising:

aligning a first opening of a foam dam with a portion of a heating element protruding from a water heater;

aligning a second opening of the foam dam with an opening in the water heater; and securing the foam dam to the opening in the water heater;

wherein the foam dam comprises an inner rim having the first opening formed therein and configured to fit around a portion of the heating element, a base wall extending outward from an inner edge of the inner rim and integral with the inner rim, a side wall extending outward from the outer edge of the inner rim and integral with the inner rim, an outer rim having the second opening formed therein and an inner edge integral with the side wall, and a lip sloping outwards from an outer edge of the outer rim towards the base wall, and wherein a surface of the inner rim and a surface of the base wall are substantially orthogonal to one another, wherein the surface of the inner rim and a surface of the side wall are substantially orthogonal to one another, wherein a surface of the outer rim and the surface of the side wall are substantially orthogonal to one another, and wherein the surface of the outer rim and the surface of the inner rim are substantially parallel to one another.

18. The method of claim 17, further comprising aligning one or more webbed features formed in the side wall of the foam dam along a path of a wire connecting the heating element to one or more other elements of the water heater such that the wire passes through at least one of the one or more webbed features.

19. The method of claim 17, further comprising attaching a cover to the wrapper of the water heater, the cover being configured to hide the foam dam and heating element from view in a first configuration and expose the foam dam and heating element in a second configuration.

* * * * *